US011229304B2

(12) United States Patent
Paulat

(10) Patent No.: US 11,229,304 B2
(45) Date of Patent: Jan. 25, 2022

(54) BEACH BLANKET WITH SAND-FILLABLE BAGS

(71) Applicant: Lindsey Paulat, Hallandale, FL (US)

(72) Inventor: Lindsey Paulat, Hallandale, FL (US)

( * ) Notice: Subject to any disclaimer, the term of this patent is extended or adjusted under 35 U.S.C. 154(b) by 0 days.

(21) Appl. No.: 16/576,270

(22) Filed: Sep. 19, 2019

(65) Prior Publication Data

US 2021/0169249 A1 Jun. 10, 2021

(51) Int. Cl.

| | |
|---|---|
| ***A47G 9/06*** | (2006.01) |
| ***A45F 3/44*** | (2006.01) |
| ***E04H 15/54*** | (2006.01) |
| ***E04H 15/62*** | (2006.01) |

(52) U.S. Cl.

CPC ..... *A47G 9/062* (2013.01); *A45F 3/44* (2013.01); *A47G 9/06* (2013.01); *E04H 15/62* (2013.01); *E04H 15/54* (2013.01); *Y10S 242/919* (2013.01); *Y10S 248/91* (2013.01)

(58) Field of Classification Search

CPC ..... A47G 9/062; A47G 9/06; A47G 21/167; A47G 21/16; A45F 3/44; E04H 15/62; E04H 15/34; Y10S 248/91; Y10S 242/919

See application file for complete search history.

(56) References Cited

U.S. PATENT DOCUMENTS

| | | | | |
|---|---|---|---|---|
| 5,018,229 | A * | 5/1991 | Eberhart | A47G 9/062 428/100 |
| 5,406,659 | A | 4/1995 | Camp | |
| 5,499,411 | A | 3/1996 | Wong | |
| 5,520,364 | A * | 5/1996 | Bloxson | E04H 15/003 248/500 |
| 5,666,678 | A | 9/1997 | Wall | |
| 6,192,536 | B1 | 2/2001 | Connors | |
| 2006/0010598 | A1 * | 1/2006 | Rusinak-Connors | A47G 9/062 5/417 |
| 2015/0013065 | A1 | 1/2015 | Ketcham | |
| 2015/0143632 | A1 | 5/2015 | Obrentz | |

FOREIGN PATENT DOCUMENTS

| | | | | |
|---|---|---|---|---|
| WO | WO-9959452 A1 * | 11/1999 | | A47G 9/062 |
| WO | 2004023939 | 3/2004 | | |
| WO | WO-2010103307 A1 * | 9/2010 | | A45C 11/00 |

* cited by examiner

*Primary Examiner* — David R Hare
*Assistant Examiner* — Madison Emanski
(74) *Attorney, Agent, or Firm* — John Rizvi; John Rizvi, P.A.—The Patent Professor®

(57) ABSTRACT

A beach blanket including a stretchable main panel having two opposite sides comprising a body supporting top side for individuals to sunbath on and a bottom side for resting on a sandy beach surface, and a plurality of invertible bags attached to perimeter of the stretchable main panel. Each bag pivots about the stretchable main panel to allow users to scoop a large quantity of sand within each bag. The sand-filled bags are positioned on the beach to provide opposing tension on the main panel to easily eject sand off the blanket, and to securely anchor the beach blanket onto a beach which also prevents wind from blowing the beach blanket away.

18 Claims, 7 Drawing Sheets

BEACH BLANKET WITH SAND-FILLABLE BAGS

FIELD OF THE INVENTION

The present invention relates to blankets, and more particularly, to a beach blanket including attached bags designed for scooping and holding sand therein where the sand-filled bags are positioned on the beach to provide opposing tension on the blanket for ejecting sand from the sunbathing surface.

BACKGROUND OF THE INVENTION

One popular activity that is enjoyed by many during the hot summer months is going to the beach to sunbath in the hot sun and swim in the ocean. In contemplation of going to the beach, individuals typically pack a variety of staples that include food, drinks, snacks, and various beach accessories such as sun screen, coolers, and chairs. An accessory that is often employed while at the beach is a beach blanket or towel. The beach blanket is laid out on the beach in a flat configuration for individuals to rest on. In practice, users typically lay the blanket on the beach and use both hands to flatten and spread out the blanket removing any wrinkles, and anchoring with belongings. There are a variety of beach blankets available on the market to accommodate both the aesthetic and utilitarian aspects desired by beach goers. As such, beach blankets come in a variety of different colors, designs, patterns, or dimensions. Whatever the appeal, young and old alike enjoy the pleasures and benefits of using beach blankets at beaches.

The wide open sandy terrain of most beaches makes it conducive for exposure to high winds or wind gusts that swirl around uplifting blankets and sand in its path. The sand can create a lot of discomfort when trying to relax at the beach. It is welcomed when children enjoy themselves digging and building sand castles. However, the sand is not welcome when it intrudes onto a beach blanket creating discomfort from the gritty texture. Beachgoers typically have to remove their belongings, pick up the blanket, shake it to remove sand and then reposition the blanket back onto the sand. It is quite frustrating for users to consistently reposition the beach blanket over the sandy surface of the beach as a result of the wind or sand landing on the blanket. Individuals find themselves either fetching the blanket that has blown away from the resting site, or removing sand and repositioning the layout of the blanket. On windy days, it is common practice for beach goers to repeat this process over and over again constantly struggling to retain the blanket in place, and shaking off sand that has migrated onto the top surface of the blanket.

Various devices and techniques have been employed to overcome the challenges beach goers face in securing their blankets on the sandy surface of the beach. A common practice often involves weighing down beach blankets with one or more objects. As such, individuals often place a weighted article along one or both sides of the blanket, or at the corners of the beach blanket to prevent the blanket from overturning as a result of wind or movement on the blanket. Individuals will often use a purse, toys, bottled drinks, a small cooler, leg of chair, or other article on a portion of the beach blanket to anchor the blanket down. Although the added weight may resolve the need for anchoring the blanket, the weight is insufficient to retain the blanket in a tensioned laid out position to permit easily removing sand from the top surface of the blanket.

Various techniques have also been used in an effort to remove the sand from the body laying surface of blankets. Some beach goers try to brush the sand off with their hands by swiping their hands over the top of the blanket while trying to retain the flat, non-wrinkled, positional layout of the blanket. As the person swipes the sand off the blanket, the weights, used to anchor the blanket, move out of position resulting in the blanket bunching up with wrinkles making it difficult to remove the top sand and forcing the user to reposition both the weights, and the blanket. Some might try to remove the sand by way of ejection, but also fail due to insufficient anchoring and not having stretching capability causing it to wrinkle and become dispositioned. Typically, most beach goers shake and reposition the blanket repeatedly to remove the sand. A blanket having a sand-free benefit is of great interest for individual beach goers using suntan lotion or oils, as the moisture provides an attractant for sand to stick to the skin. So being able to quickly remove top sand, creating a sand-free sun bathing surface is of great value and makes the day at the beach more enjoyable.

Accordingly, there exists a need to solve at least one of the aforementioned problems mentioned herein, and to provide a beach blanket that is adequately anchored on a beach with ease, and provides opposing tension on the structural layout of the blanket for easily, quickly, and efficiently ejecting sand off the top surface of the blanket during use, while preventing the wind from uplifting and blowing the blanket away.

SUMMARY OF THE INVENTION

The present invention is directed to a beach blanket including a plurality of pivotally attached bags that are designed for digging and scooping a ballast, such as sand on a beach, into each bag where the sand-filled bags are positioned in a spread-out formation on the beach to provide opposing tension on the main panel of the beach blanket to easily, quickly, and efficiently eject sand from the sunbathing surface of the blanket while securely anchoring the blanket on the beach to resist wind. Each bag includes a semi-oval or semi-ellipse shape designed to hold a large quantity of sand therein.

A first embodiment of the invention provides a beach blanket comprising: a stretchable, main panel having opposite sides including a body supporting side and a bottom side, a plurality of invertible bags, each bag including a collapsible surrounding wall having a closed bottom, an open top defining a top perimeter and a cavity for removably holding a ballast, and a closure for closing the open top, and wherein a portion of each of the plurality of invertible bags is attached to the stretchable main panel to providing an articulated connection where each of the plurality of invertible bags pivots freely about the stretchable main panel to scoop ballast in the bags.

In one aspect, the body supporting side, and the bottom side comprise either a single layer, or multiple layers of material.

In one aspect, the stretchable main panel comprises a rectangular stretchable main panel having four corners, and a surrounding border.

In another aspect, each portion of a first, a second, a third, and a fourth of said plurality of invertible bags is pivotally attached to the respective four corners of the rectangular stretchable main panel to provide an articulated connection in which each of the invertible bags rotate or pivots freely for scooping the ballast therein.

In one aspect, each of the plurality of invertible bags is permanently, or removably pivotally attached to the four corners of the rectangular, stretchable main panel.

In yet another aspect, the border is defined by lateral edges, and longitudinal edges, where an elastic member is separately enclosed within the border, or comprises an elastic material that is interwoven with the border, to allow the lateral and longitudinal edges of the stretchable main panel to resiliently expand and contract.

In another aspect, the top perimeter, of each of the plurality of bags, includes a channel spanning the circumference of the top perimeter and includes at least one opening extending within the channel where the closure comprises a draw string enclosed within the channel and extending partially outwards from the at least one opening to openingly close the cavity. An optional spring-loaded lock may be provided with the drawstring.

In yet another aspect, a portion of each of the plurality of invertible bags comprises a portion of the collapsible surrounding wall, a portion of the top perimeter, or both.

In another aspect, each of the plurality of invertible bags includes a hand contact surface readily engaging inner surface areas of a user's hands, and a ballast contact surface engaging with the ballast when digging and scooping the ballast.

In another aspect, the pair of straps includes a first strap and a second strap, each strap being attached to the collapsible surrounding wall. Also, the plurality of invertible bags may include a flap that is permanently or removably attached to, or adjacent the top perimeter, or to the collapsible surrounding wall to prevent the ballast from contacting a user's hands when scooping sand.

In another aspect, any or all of each of the plurality of invertible bags includes a storage pouch having a closure for removably retaining items therein.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a beach blanket including a stretchable main panel having opposite sides comprising a body supporting side for individuals to lay on, and a bottom side to rest on the sandy beach, and a plurality of invertible bags each pivotally attached to the corners of the stretchable main panel, and used to dig, scoop and hold sand therein. The sand-filled bags are displaced outwards to provide opposing tension on the stretchable main panel, for easily, quickly, and efficiently ejecting sand off the top layer of the blanket, and for anchoring the beach blanket on a beach to prevent wind from blowing away the blanket.

Figure 1:
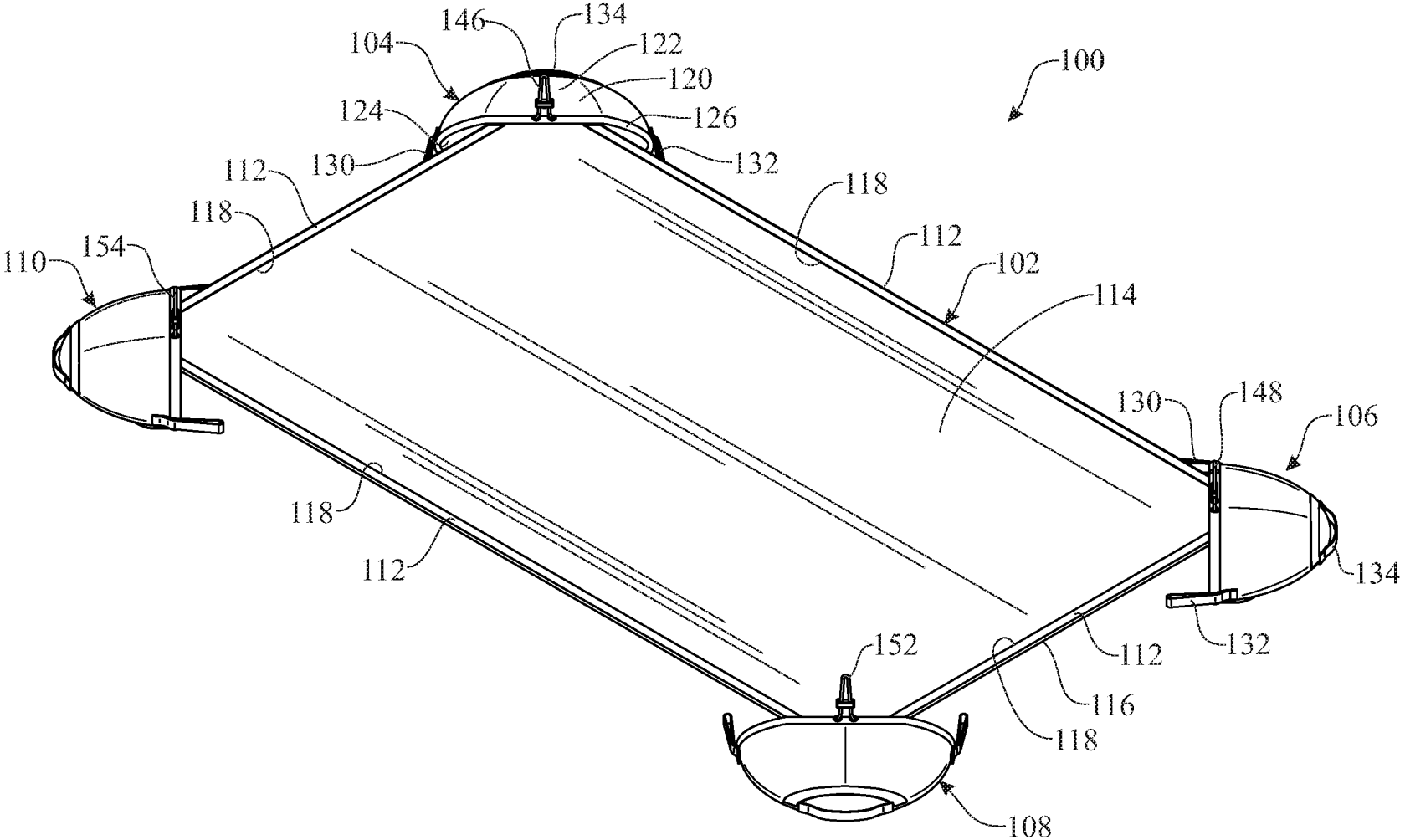
FIG. 1 presents a top, perspective view of a beach blanket, showing a plurality of invertible bags attached to a stretchable main panel for scooping and holding a ballast such as beach sand, where each bag includes straps, a bottom strap, and a closure, in accordance with one embodiment of the present invention.
Figure 2:
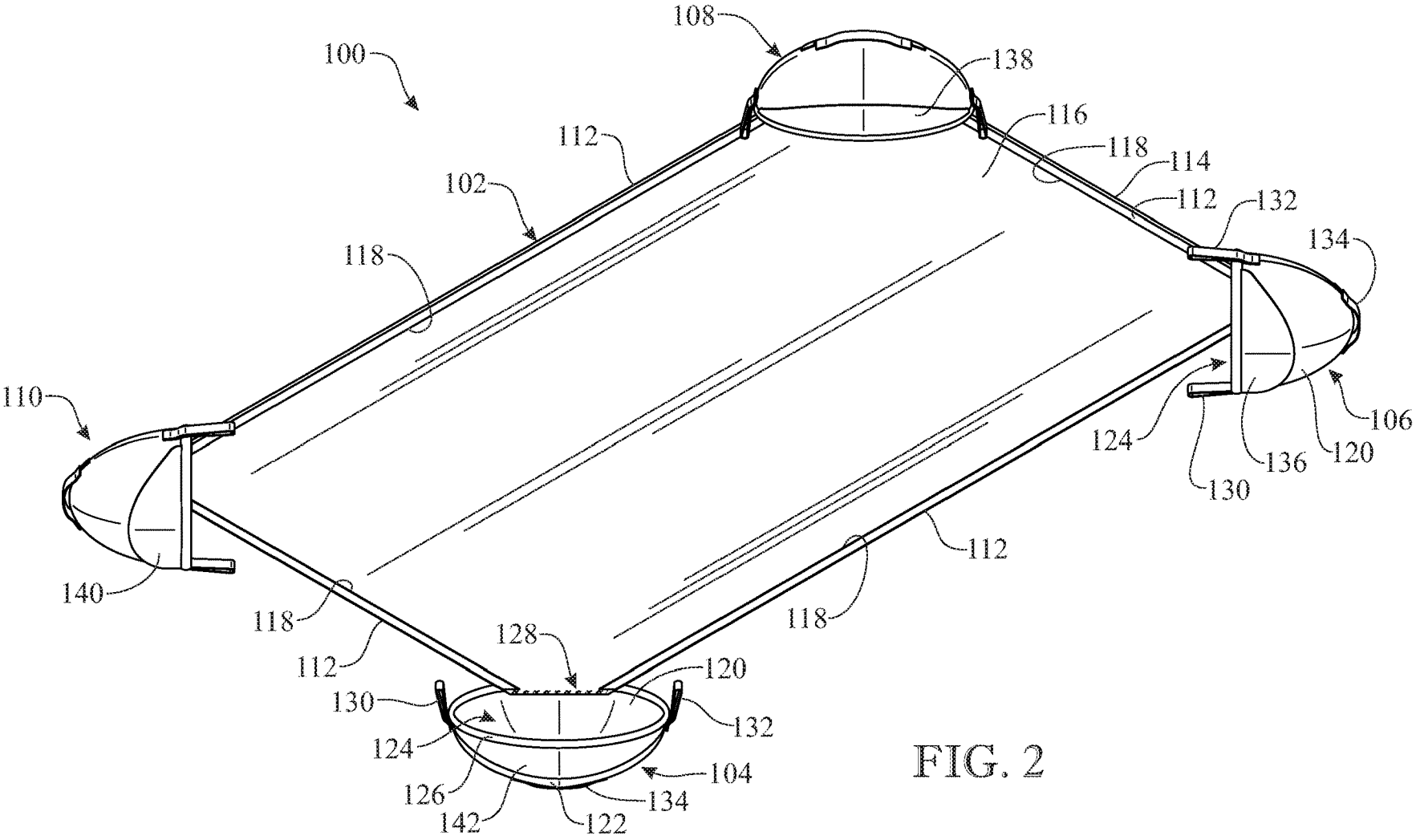
FIG. 2 presents a bottom, perspective view of the beach blanket of FIG. 1, showing each of the plurality of invertible bags including an optional flap to prevent sand from coming into contact with a person's hands when scooping beach sand into the bag, in accordance with the embodiment of the present invention.

Referring now to the figures wherein like numerals are represented by like elements throughout, there are shown in FIGS. 1 and 2 a top, and a bottom perspective view, respectively, of a beach blanket 100 including a stretchable main panel 102, and a plurality of invertible bags 104, 106, 108, 110 attached at various positions along the peripheral edge, border, or outer perimeter 112 of the stretchable main panel 102, in accordance with one embodiment of the present invention. It is appreciated that reference herein is made to various terms throughout the description including the terms, beach and sand. It will be understood that the term, "beach" as used herein not only refers to and includes the ordinary meaning of term relating to any and all areas designated for recreational use associated with oceans, but also includes areas found in close proximity to streams, ponds, lakes, or rivers including coastland, lakeshore, seacoast, or riverside, to name a few. Also, the term, "sand" as used herein, may include any and all natural or artificial sand, small rocks, pebbles, stones, dirt, granules, soil, fill, gravel, or any other ballast amendable for removable storage within each bag 104, 106, 108, and 110.

The stretchable main panel, generally denoted at 102, comprises two opposite sides including a body supporting side 114 designated as a laying surface for individuals to lay on, and a bottom side 116 for placement on a sandy surface of a beach. In one preferred embodiment, the stretchable main panel 102 comprises a generally rectangular geometric shape dimensioned to accommodate the overall length of a human body, and includes lateral and longitudinal borders 112 intersecting perpendicular at four corners of the rectangular panel. The dimensional configuration of the stretchable main panel 102 is selected to accommodate use by any number of individuals, and as such, may comprise any dimensional length and/or width. For example, the stretchable main panel 102 may be designed for use by a single person, a couple, or made large enough to accommodate a family. The stretchable main panel 102 may comprise other geometrical shapes and dimensions including a round, triangular, oval, or square shape. While at the beach, individuals are typically dressed for the occasion of sunbathing, or swimming, thus exposing a greater area of skin. Since the exposed skin will likely come into contact with the top side 114 of the stretchable main panel 102 when the person is laying on the beach blanket 100, it is contemplated that the top side 114 comprise a soft fabric, textile, or cloth material that will not irritate the user's skin. As such, the top side 114 may comprise a soft, woven or non-woven, synthetic or non-synthetic fabric, textile, or cloth material including, but not limited to, a terry cloth, a French cloth, micro-fibers, cotton, polyester, chiffon, or any combination thereof. The top side 114 may comprise a single layer, or multiple layers of fabric, cloth or textiles that comprise the same or different material. In one embodiment, the top side 114 comprises a single layer having absorbent properties adapted for soaking up liquid or moisture. Alternatively, the top side 114 may comprise a first layer that is permanently or releasably attached to a second layer having impermeable or absorbent characteristics allowing moisture to pass through the first layer and flow down to the second layer thus keeping the first layer dry. Also, in one non-limiting embodiment, the first layer may be removably attached to the second layer using any well-known fastener allowing users to remove the first layer for washing, repair or replacement. In one embodiment, the bottom side 116 may comprise an impermeable, non-absorbent material to prevent moisture from reaching the top side 114 causing discomfort to users. As such, the bottom side 116 may comprise a nylon material to prevent sand from sticking to its surface, a laminated fabric, a woven or non-woven fabric treated with a water-repellant or cooling chemical, or simply entail the same fabric material used in constructing the top side 114, keeping with the purview that the stretchable main panel 102 be machine washable. It will be appreciated that the stretchable main panel 102 may comprise a wide range of stretchability in which users can pinch any portion of the panel and pluck the panel to spring and propel any sand on the panel away from the top side 114. In one preferred embodiment, the main panel 102 comprises a single layer of material comprising a knitted fabric or cloth, such as a stretchable terry cloth having a soft upper surface. The main panel 102 may include water-resistant or water-repellant properties.

With continued reference to FIGS. 1 and 2, a variation of the stretchable main panel 102 may include a border 112 that incorporates elastic properties in which the border 112 resiliently stretches or expands in length in conjunction with the stretching material of the stretchable main panel 102. For this reason, the border 112 may incorporate one or more elastic members or a stretchable material. In one embodiment, a section of the stretchable main panel 102 may be folded over an elastic member where a peripheral edge of the folded section is sewn along a seam, depicted at 118. The section of the stretchable main panel 102, or the elastic member itself may comprise spandex, lycra, or any other stretchable material. The combinational, functional aspect of the elastic member(s) and stretchable main panel 102 permits readily stretching or spreading out, the stretchable main panel 102 when displacing the positional layout of the sand-filled bags 104, 106, 108, and 110. The incorporated elastic member generally spans the length of each lateral and longitudinal border 112 in a rectangular body, and may include a single member, or separate and distinct members, strands, or fibers that are selectively attached together at designated points via, stitching or gluing. The elastic member can be interwoven within the border in one alternative embodiment. Also, because the beach blanket 100 is likely exposed to high temperatures of the sun, and to salt from ocean water, the border 112 or elastic member may be coated with a protective material, or comprise water-resistance properties. The elastic member may comprise a resilient rubber material, or a combination of fabric and rubber materials. The material attached to the elastic member may be bunched up, or gathered together where the material extends flat when the elastic member is stretched to capacity. It will be appreciated that in embodiments where the stretchable main panel 102 comprises a round, oval or other geometrical shape, the border 112 as used in such configurations may also comprise or incorporate a resilient, stretchable material or member.

With continued reference to FIGS. 1 and 2, the beach blanket 100 includes a plurality of invertible bags 104, 106, 108, 110 shown openly expanded in preparation for use. Each bag 104, 106, 108, 110 is configured to dig, scoop and store a large amount of sand that is used as a ballast to securely anchor the pockets and beach blanket 100 on the sandy surface of a beach. Each bag 104, 106, 108, 110 generally includes a single panel, or multiple panels that are sewn together, to define a receptacle having a collapsible surrounding wall 120, a closed bottom 122, and a top opening 124 having an opening perimeter 126, as better illustrated in relation to bag 104 in FIG. 2. Each bag 104, 106, 108, 110 may be constructed from the same or different material used to construct the stretchable main panel 102. In one embodiment, each bag 104, 106, 108, 110 is constructed from a nylon material to prevent sand from sticking onto the surface of the sidewall 120 allowing sand to slide freely or exit freely out from the bags 104, 106, 108, 110 when emptying the sand from the bags. Each bag 104, 106, 108, 110 comprises any of a semi-oval, semi-circular, triangular shape, or semi-ellipse shape or configuration, or any combination thereof, that permits digging, scooping, and storing a large quantity of sand therein.

An exemplified feature of the beach blanket 100 includes the ability for each invertible bag 104, 106, 108, 110 to pivot or articulate about the corner regions of the stretchable main panel 102 with ease and efficiency. The articulated motion of each bag 104, 106, 108, 110 allows users to easily maneuver, and manipulate each bag 104, 106, 108, 110 when inserting each bag into the sandy beach to dig and scoop in sand. The articulated connection is defined by a portion of the collapsible surrounding wall 120, or a portion adjacent to, or comprising, the perimeter 126 of the top opening 124, of each bag 104, 106, 108, 110 being attached to respective corner regions of the stretchable main panel 102. In one example, the corner regions of the main panel 102 are each joined to a section or portion of the opening perimeter 126 of each bag 104 by sewing or stitching, defining a seam, denoted at 128. The seam 128 provides a hinge mechanism, or articulated connection, that permits each bag 104, 106, 108, 110 to rotate or pivot freely about the corners of the stretchable main panel 102 generally greater than 350-degree angle of rotation. The articulated motion of each bag 104, 106, 108, 110 provided by the seam 128, allows users to easily manipulate, position, and insert the bag 104, 106, 108, 110 into the sandy beach to dig and scoop in sand, and to easily remove sand from each bag 104, 106, 108, 110 with ease and efficiency. In one non-limiting embodiment, each bag 104, 106, 108, 110 may be permanently or removably attached to the corners or corner regions of the stretchable main panel 102 using a variety of well-known stitching processes or fasteners that permit removeable attachment of the bags 104, 106, 108, 110 to the corners of the stretchable main panel 102. For example, fasteners such as snaps, magnets, buttons, zippers, or clips would allow users to removably attach each bag 104, 106, 108, 110 to the corner regions of the stretchable main panel 102 to permit replacement, repair, or the ability to rinse or wash the bags 104, 106, 108, 110 after use. Male/female connections may be provided on each bag 104, 106, 108, 110 and respective corners of the stretchable main panel 102. It will be understood that in one non-limiting embodiment, each bag 104, 106, 108, 110 may be integrally formed with the stretchable main panel 102 thus eliminating the need for employing a separate process of sewing to stitching each bag 104, 106, 108, 110 to the corners of the stretchable main panel 102.

With continued reference to FIGS. 1 and 2, each bag 104, 106, 108, 110 includes a pair of straps 130, 132 extending from the collapsible surrounding wall 120, and a bottom strap 134 attached to the bottom 122 surface area. In one exemplary embodiment, the straps 130, 132 each comprise loops that are formed by folding a strap and stitching the ends of the strap together on the surface of the wall 120 of each bag. The straps 130, 132 are employed to assist users in effectively emptying sand from each bag 104, 106, 108, 110 after use. Each bag also includes a bottom strap 134 in which distal ends of the bottom strap 134 are sewn to the bottom 122. Each bottom strap 134 is used for repositioning the bags to increase tension after being filled with sand, and to empty the sand from the bags when lifted after opening it by using the straps 130, and 132. It will be appreciated that the straps 130, 132, and bottom straps 134, of each bag 104, 106, 108, 110, may be permanently or removably attached using well-known fasteners rather than by a process of sewing or stitching. For example, such fasteners may include snaps, buttons, Velcro™, or clips. Also, bottom strap 134 may comprise a single strap or two separate and distinct straps designated for each thumb of the right and left hand of users. The bottom straps 134 may also comprise a stretchable material that permits users to expand their hands further apart from one another when the hands are positioned on the bags 104, 106, 108, 110 to scoop sand.

In one, non-limiting embodiment, each bag 104, 106, 108, 110 may optionally include a flap 136, 138, 140, 142, as better illustrated in FIG. 2, to prevent sand from coming into contact with the user's hands when digging and scooping sand. Each flap 136, 138, 140, 142 comprises generally a rectangular, semi-circular, semi-oval, or semi-elliptical shape, having a lateral edge and an arcuate edge. The lateral edge of each flap is affixed along the opening perimeter 126, as shown with bag 104 in FIG. 2, and an arcuate edge extending towards the bottom end 122. Each flap 136, 138, 140, 142 may comprise the same or different materials used to construct bag 104, 106, 108 and 110, and may include one or more fasteners in which users can easily attach or remove each flap from respective bags if desired. Such fasteners may include a zipper, snaps, buttons, Velcro™, magnets, or clips. Each flap 136, 138, 140, 142 may comprise a single piece that encircles the circumference of each bag 104, 106, 108, 110, or comprise any number of separate and distinct pieces. It will be appreciated that in one embodiment, the beach blanket 100 may include bags 104, 106, 108, 110 having permanently or removably attached flaps, or having no bag flaps at all. Thus, bag flaps 136, 138, 140, 142 may be provided as an optional feature to use with the beach blanket 100.

Figure 3:
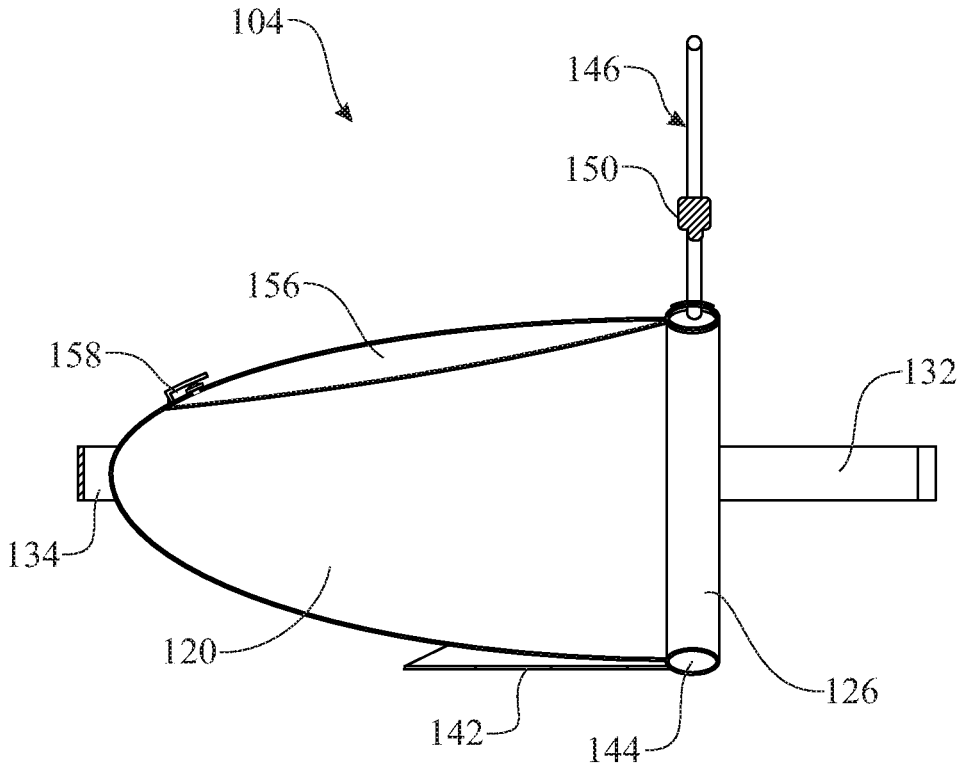
FIG. 3 presents a cross-sectional view of one of the plurality of invertible bags of FIG. 1, showing a partial view of a channel enclosing a draw string used for closing the opening a cavity retaining beach sand, and a storage pouch for storing a variety of items, in accordance with an embodiment of the present invention.

Turning now to FIG. 3 there is shown a cross-sectional view of one bag, denoted at 104, showing a partial view of an opening perimeter 126 having a channel 144 adapted for enclosing a draw string 146 therein to operatively constrict or close the perimeter 126 and opening of the bag 104 thereby enclosing sand therein. The bag 104 further includes a storage pouch 156 for storing a variety of items or articles typically used while at the beach. It is noted that for illustrative purposes and without limitation, description made regarding functional and constructional features of bag 104, is also applicable to bags 106, 108 and 110 as well. Each opening perimeter 126 of each bag 104, 106, 108, 110 includes a channel 144 sized and dimensioned to operatively enclose a draw string 146 having a predetermined length. A spring-loaded cord lock 150 is provided to tighten the draw string 146 to retain the perimeter opening 126 closed. The spring-loaded lock 150 comprises any well-known cord lock typically used for selectively adjusting the length of cords or ropes. The draw string 146 may comprise a cotton, or nylon string or rope having a predetermined diameter and length associated with the size and dimension of the channel 144, and the circumference of each bag 104, 106, 108, and 110. Each bag 104, 106, 108, 110 includes a drawing string 146, 148, 152, 154, to close each individual bag, as better illustrated in FIG. 1. It is appreciated that an elastic member or stretchable material may be incorporated within the opening perimeter 126 of one or more bags 104, 106, 108, and 110. One or more bags 104, 106, 108, 110 includes a storage pouch 156 incorporated within or provided on, the sidewall 120 of each bag and sized to store a variety of different items therein, including, but not limited to, keys, cell phone, wallet, money, jewelry, earbuds, CD's, food, drinks, an articles of clothing, or other items typically used by beach goers. A pouch closure 158 comprising any of a zipper, snaps, magnets, buckles, buttons, or the like is employed to securely close the opening of the storage pouch 156 to securely retain the items therein.

Figure 4:
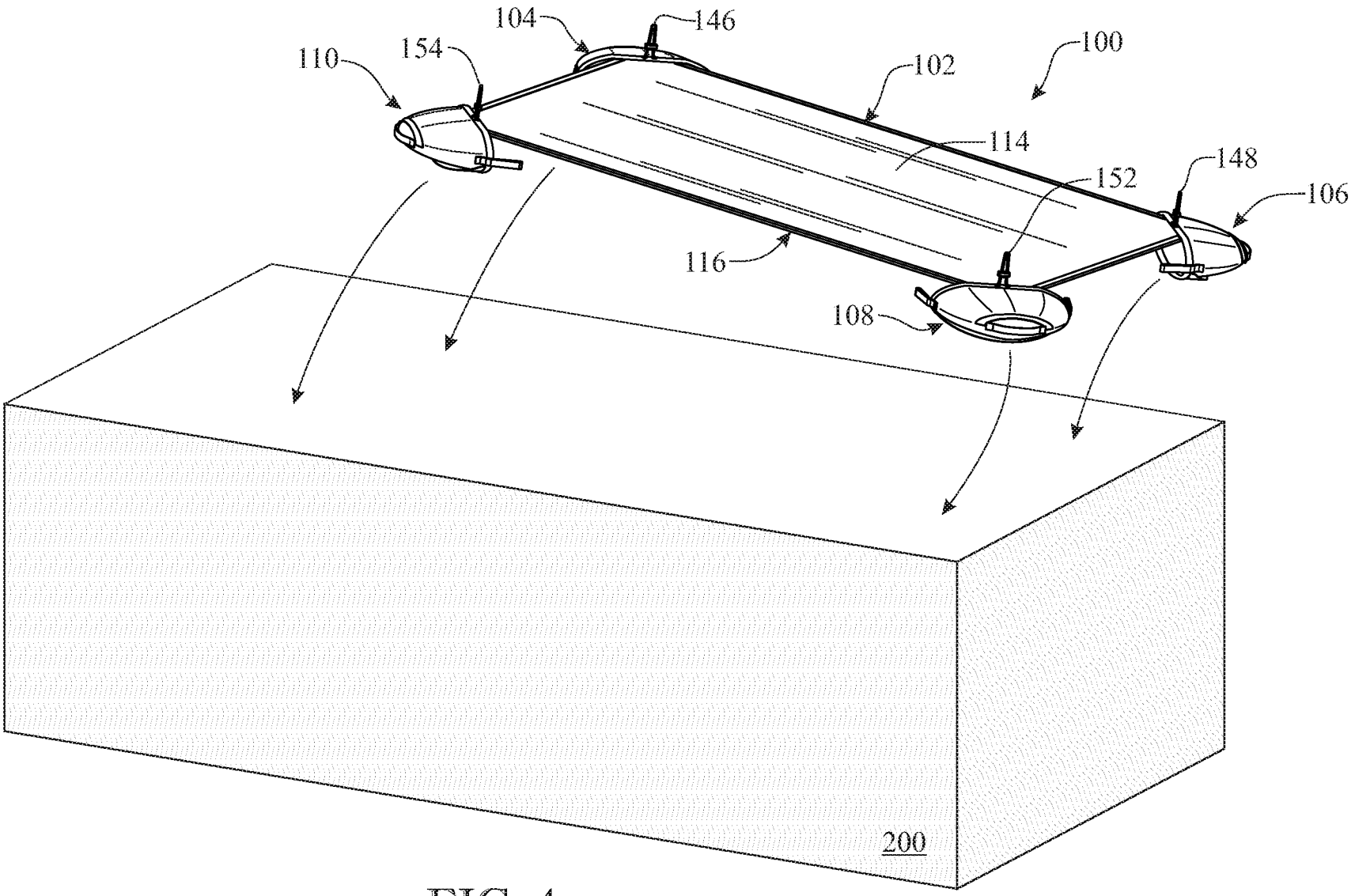
FIG. 4 presents an operative, perspective view of the beach blanket of FIG. 1, readily disposed on a sandy surface of a beach represented as a block portion, each of the plurality of invertible bags readily positioned for digging and scooping sand therein, in accordance with the embodiment of the present invention.

With reference now made to FIG. 4 there is shown an operative, perspective view of the beach blanket 100 of FIG. 1, readily disposed on the sandy surface of a beach 200 generally represented as a block section of a beach, in accordance with the embodiment of the present invention. Upon selecting a designated resting area on the beach 200, users spread out the beach blanket 100 on the sandy surface of the beach 200 with the bottom side 116 of the stretchable main panel 102 laid to rest on the sandy surface, as shown by directional arrows. Each bag 104, 106, 108, 110 is laid out from respective corners of the stretchable main panel 102 onto the sandy surface. Once properly situated, users begin filling each individual bag 104, 106, 108, 110 with sand by digging and scooping the sand with the bag.

Figure 5:
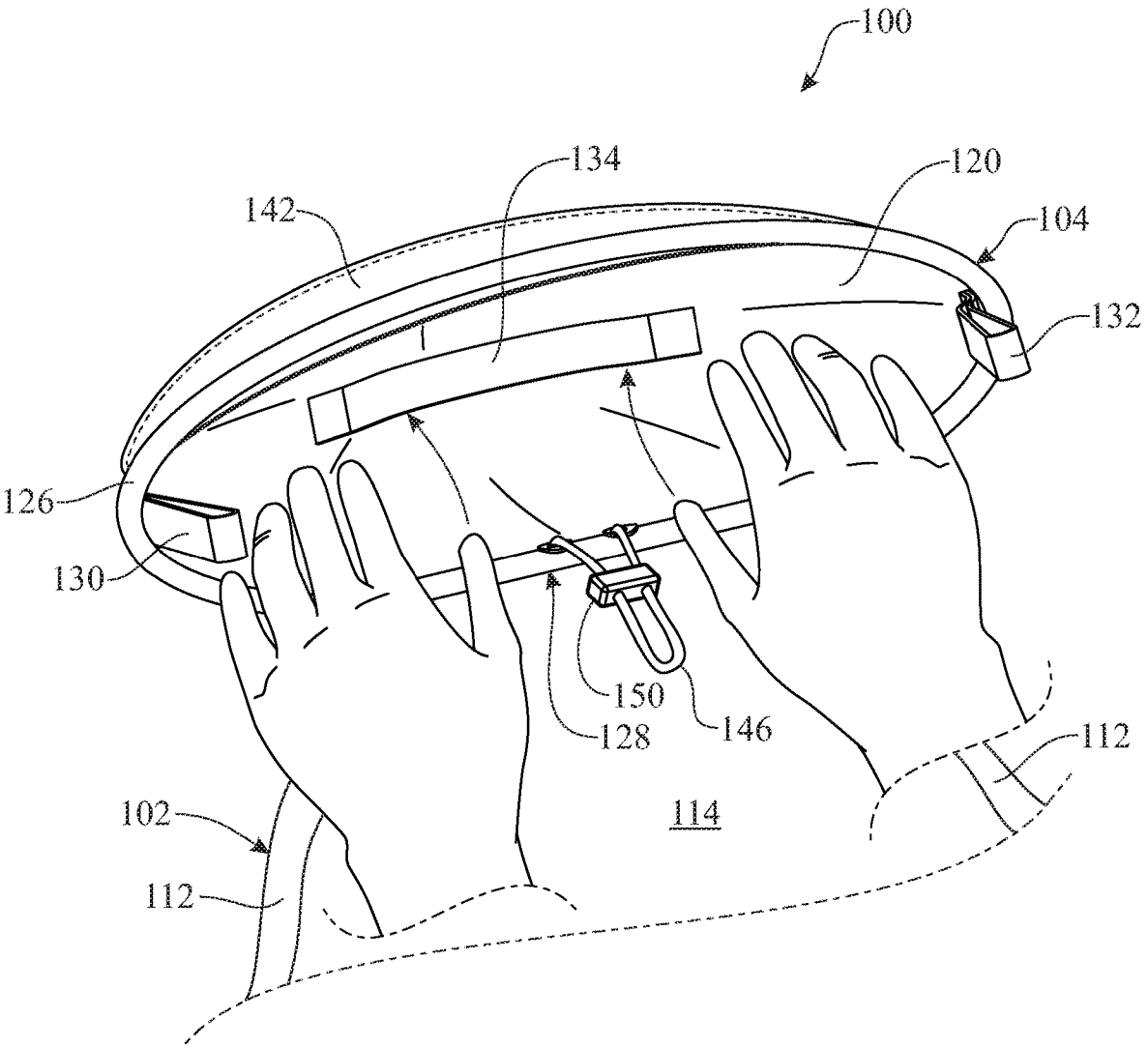
FIG. 5 presents a schematic, partial view of a user's hands positioned over one of the plurality of invertible bags, showing readily sliding both hands into an inverted bag to dig sand into a pile and revert the bag to scoop in a large quantity of sand within the bag, and closing the bag with the draw string, in accordance with an embodiment of the present invention.
Figure 6:
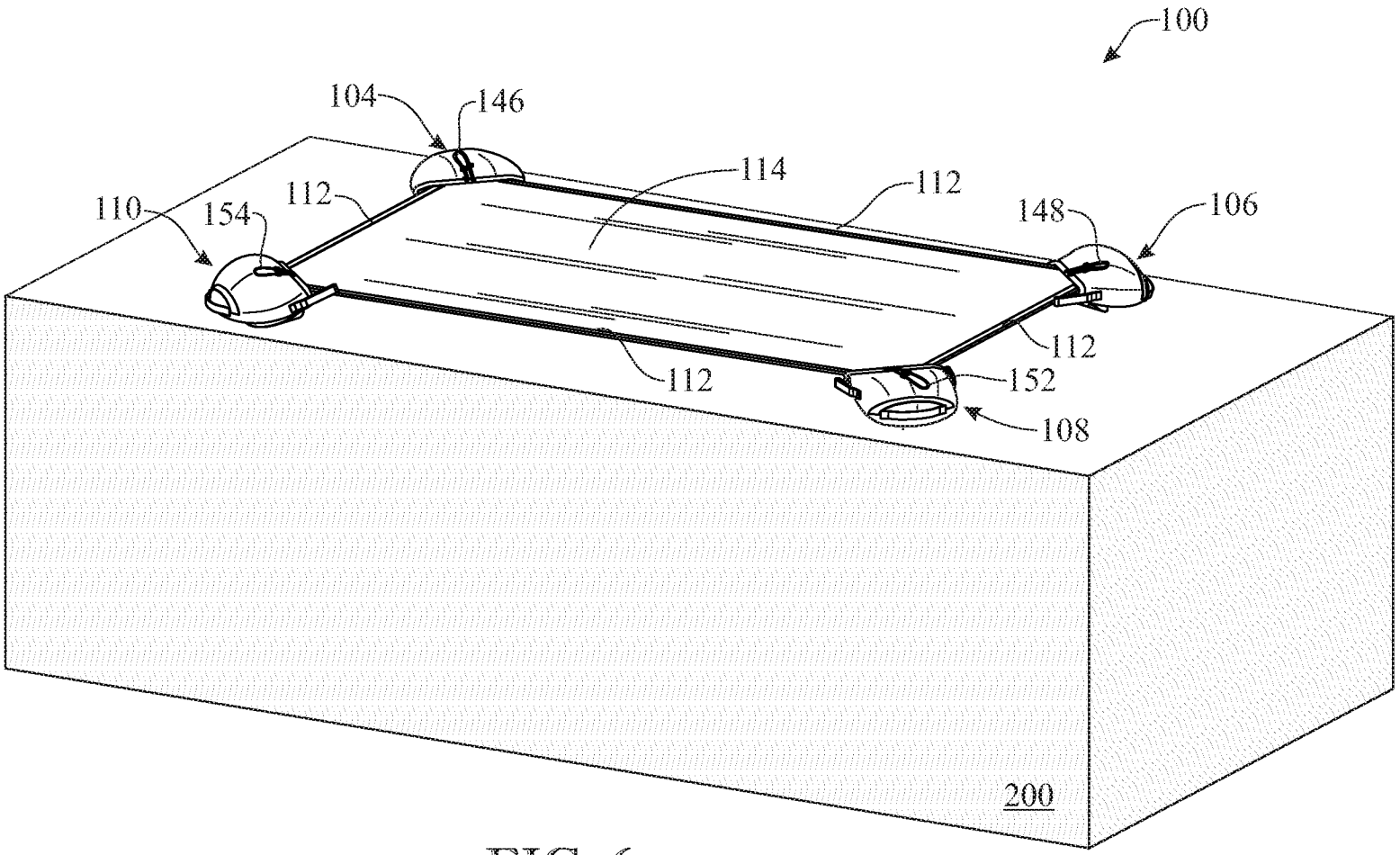
FIG. 6 presents a side, perspective view, of the beach blanket of FIG. 4, showing each sand-filled bag displaced outward on the beach to provide opposing tension on the blanket by expanding the stretchable main panel in a non-wrinkled, stretched out manner to easily propel sand off the blanket, in accordance with an embodiment of the present invention.

As illustrated in FIG. 5, each bag 104 is used to dig and scoop a large quantity of sand with the bag 104 without the use of tools. The bags 104, 106, 108, 110 are filled with sand using the same technique, process, or method as exemplified in FIG. 5. Upon laying the beach blanket 100 in the desired location on the beach, users begin filling each bag 104, 106, 108, 110 with sand, by situating themselves in front of the open part of the bag to be filled. Users reach out and place both hands onto the non-inverted portion of the sidewall 120 and spread away from each other to tension the bottom of the bag. The inner surface of each hand including the phalanges of the fingers lay flat against the sidewall 120 material of the bag 104 and the user, using the inner surface of the hand, and the distal end of the fingers, applies a downward, scooping motion forcing a portion of the bag 104 into the sand digging and scooping a large amount of sand into a pile. The bag 104 is then reverted and while doing so, the pile of sand is scooped up into the bag 104. Upon filling the bag 104 with sand, the user pulls the draw string 146 to forcibly constrict the opening perimeter 126 of the bag 104 and operates the spring-loaded lock 150 to close the opening 124, shown in FIG. 2, to retain the scooped sand within the bag 104. This process is repeated until all bags 104, 106, 108, 110 are filled with sand. The constructional semi-oval, or semi-ellipse shape of each bag 104, 106, 108, 110 permits a large amount of sand to be easily scooped and enclosed within the cavity of each bag by a user's hands without having to use tools. The larger sized bags 104, 106, 108, 110 hold more sand to provide heavier or greater weight at the corners of the main panel 102 thus maintaining opposed tension on the main panel 102 and preventing the main panel 102 from bunching, or wrinkling when users remove by ejecting sand off the top side 114.

Upon filling each bag 104, 106, 108, 110 with sand, users displace or position each sand-filled bag 104, 106, 108, 110 outwards, in a spaced-apart relation with one another, on the beach 200, to stretch the main panel 102 and elastic members enclosed within the border 112 in a non-wrinkled, stretched out fashion to provide opposing tension on the top laying surface of the beach blanket. Sand migrating onto the top laying surface is easily and quickly ejected off the surface, by simply pinching a small section of the stretchable main panel 102 between two fingers, lifting the portion section and releasing the section to eject, or propel any sand off the blanket. The displaced weight of the sand-filled bags 104, 106, 108, 110 provides opposing tension to expand the stretchable material of the main panel 102 allowing users to easily pluck the main panel 102 to spring and propel sand off the top side 114.

Once the beach blanket 100 is properly anchored for use on the beach 200, users can also store any number of items in one or more storage pouches 156 provided on one or more bags 104, 106, 108 and 110, as shown in FIG. 3. Each storage pouch 156 may comprise any number of pouches, each dimensionally sized to store designated items, or any number of different items including for example, keys, wallet, food, drinks, bottles, containers, utensils, cell phone, cosmetics, hair brush and other items.

Figure 7:
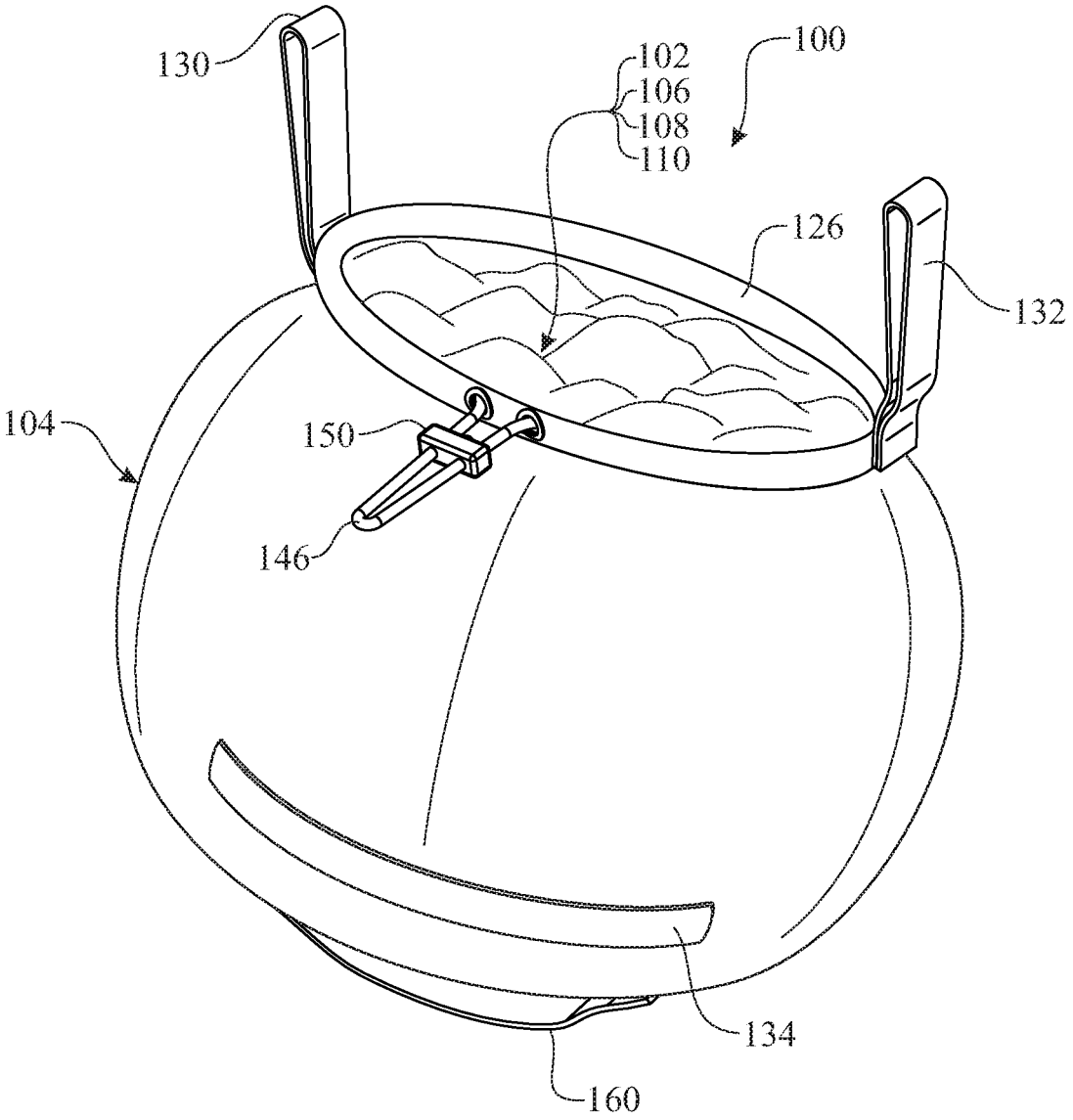
FIG. 7 presents an isometric view of one bag of FIG. 1, showing the stretchable main panel and three of the invertible bags removably stored within one of the plurality of invertible bags for easily carrying and transporting the beach blanket, in accordance with an embodiment of the present invention.

When getting ready to leave the beach for the day, users loosen each spring-loaded lock 150, of each bag 104, 106, 108, 110 to extend respective draw strings 146, 148, 152, 154, as shown in FIG. 4, and remove the sand from each bag 104, 106, 108, and 110. Users can use the assistance of the straps 130, 132 to force sand out. Once sand is fully removed from each bag 104, 106, 108, 110, the stretchable main panel 102, and three of the emptied bags 106, 108, 110 are folded and stuffed into a designated storage bag 104, as illustrated in FIG. 7. A carrying strap 160 is provided on the outer surface of the sidewall 120 of the bag 104 for carrying and transporting the beach blanket 100 from place to place. The draw string 146 can be used to constrict the opening perimeter 126 and the spring-loaded lock 150 operated to securely retain the stretchable main panel 102 and emptied bags 106, 108, 110 within the designated storage bag 104. It is appreciated that any bag 104, 106, 108, 110 may be used as the designated storage bag, or alternatively, one bag may be selected and configured as the designated storage bag.

It is appreciated that several optional features may be employed or incorporated with the beach blanket 100 without departing from the scope of the invention. For example, the beach blanket 100 may include an inflatable or plush-filled pillow that is permanently, or removably attached to the stretchable main panel 102 to rest a user's head on when laying on the blanket. A series of grommets may be provided anywhere along the border 112 for attaching articles to the blanket 100. Also, fasteners may be provided on the top side 114 of the stretchable main panel 102 to removably attach a blanket for covering the person laying on the blanket 100. Although the bags 104, 106, 108, 110 are shown attached to the four corners of the stretchable main panel 102, it is also contemplated that the bags 104, 106, 108, 110 can be attached anywhere along the perimeter of the stretchable main panel 102 without compromising the functional attributes of anchoring the beach blanket 100. Also the plurality of bags 104, 106, 108, 110 may comprise any number of bags. One or more storage pouches may be permanently, or removably, provided or attached anywhere on the top side 114 of the stretchable main panel 102. Also, each bag 104,106, 108, 110 may include indicia or markings provided on the surface of the sidewall 120 to indicate where and/or how to position the user's hand when using the bags 104, 106, 108, 110 to scoop sand. For example, indicia or markings representing the imprint or boundary lines of a hand can be provided on any or all bags 104, 106, 108, 110 using any well-known printing, sewing, embossing, or painting technique or process. The beach blanket 100 may exhibit a certain aesthetic appeal where the stretchable main panel 102 comprises a particular motif, silhouette of an animal, insect, or fish, incorporate a sports team logo or mascot, and include indicia comprising words, letters, numbers, characters, symbols, quotes, photos, patterns or designs.

While the preferred embodiments of the invention have been described above, it will be recognized and understood that various modifications can be made in the invention and the appended claims are intended to cover all such modifications, which may fall within the spirit and scope of the invention.

What is claimed is:

1. A beach blanket comprising:

a stretchable main panel having opposite sides including a body supporting top side and a bottom side, said stretchable main panel further including a border having an elastic member, wherein said border is configured to resiliently stretch or expand in length in conjunction with said stretchable main panel; and a plurality of invertible bags, each bag including a collapsible surrounding wall having a closed bottom, an open top defining a top perimeter, and a cavity for removably holding a ballast;

wherein a portion of each of said plurality of invertible bags is attached to said stretchable main panel providing an articulated connection where each of said plurality of invertible bags pivots freely about said stretchable main panel to scoop said ballast with said each bag and wherein said top perimeter of each of said plurality of invertible bags includes a channel having at least one opening extending within said channel, said closure comprising a drawstring enclosed within said channel and extending partially outwards from said at least one opening, said drawstring openly closing said cavity, and further wherein tension created by said main panel and said plurality of invertible bags holding a ballast, in conjunction with said elastic member is configured to eject a sand from said top side of said main panel.

2. The beach blanket of claim 1, wherein said body supporting top side and said bottom side each comprise either a single layer or multiple layers.

3. The beach blanket of claim 2, wherein said body supporting top side comprises a soft fabric material.

4. The beach blanket of claim 3, wherein each of said plurality of invertible bags includes a hand contact surface readily engaging an inner surface area of a user's hands to scoop said ballast, and a ballast contact surface engaging with said ballast.

5. The beach blanket of claim 1, wherein said stretchable main panel comprises a rectangular stretchable main panel having four corners.

6. The beach blanket of claim 5, wherein said portion of each of said plurality of invertible bags, is attached to respective four corners of said rectangular stretchable main panel.

7. The beach blanket of claim 6, wherein said portion comprises a section of said collapsible surrounding wall, or a section of said top perimeter, of each bag, said section attached to said corners by stitching.

8. The beach blanket of claim 7, wherein said border defines a pair of lateral edges and a pair of longitudinal edges, said elastic member permitting said pair of lateral edges and said pair of longitudinal edges to resiliently expand and contract.

9. The beach blanket of claim 7, wherein each of said plurality of invertible bags comprises any of a semi-oval shape, a semi-ellipse shape, a triangle shape, or a semi-circular shape.

10. The beach blanket of claim 7, wherein each of said plurality of invertible bags includes a pair of straps attached to said collapsible surrounding wall, and a bottom strap having opposite ends attached to said closed bottom.

11. The beach blanket of claim 10, wherein said pair of straps includes a first strap and a second strap each attached to said collapsible surrounding wall.

12. The beach blanket of claim 9, wherein each of said plurality of invertible bags includes a flap having a lateral edge attached along said top perimeter of each of said plurality of invertible bags such that an inner surface of said flap faces said ballast contact surface.

13. The beach blanket of claim 12, wherein each flap is permanently or removably attached to each of said plurality of invertible bags.

14. The beach blanket of claim 9, wherein any or all of each of said plurality of invertible bags includes a storage pouch provided on said collapsible surrounding wall and including a closure, said storage pouch accessible to store items therein when any or all of each of said plurality of invertible bags are filled with said ballast, and positioned to anchor said stretchable main panel.

15. The beach blanket of claim 14, wherein said stretchable main panel, and at least three of said plurality of invertible bags are removably stored within one of said plurality of invertible bags.

16. The beach blanket of claim 7, wherein said elastic member comprises any of an elastic band separately enclosed within said border, or an elastic material that is interwoven with said border.

17. A beach blanket comprising;

a rectangular, stretchable main panel having opposite sides including a body supporting top side and a bottom side, said stretchable main panel further including a border having an elastic member, wherein said border is configured to resiliently stretch or expand in length in conjunction with said stretchable main panel;

a plurality of invertible bags, each bag including a collapsible surrounding wall having a closed bottom, an open top defining a top perimeter, a cavity for removably holding a ballast, each of said plurality of invertible bags including a semi-oval or semi-ellipse shape, wherein said top perimeter of each of said plurality of invertible bags includes a channel having at least one opening extending within said channel, said closure comprising a drawstring enclosed within said channel and extending partially outwards from said at least one opening, said drawstring openly closing said cavity, and wherein tension created by said main panel and said plurality of invertible bags holding a ballast, in conjunction with said elastic member is configured to eject a sand from said top side of said main panel; and further wherein a portion of each of said collapsible surrounding wall or said top perimeter of each plurality of invertible bags is attached to respective corners of said stretchable main panel providing an articulated connection where each of said plurality of invertible bags pivot freely about said corners when scooping said ballast.

18. A beach blanket comprising;

a rectangular, stretchable main panel having opposite sides including a body supporting top side and a bottom side, said stretchable main panel further including a border having an elastic member, wherein said border is configured to resiliently stretch or expand in length in conjunction with said stretchable main panel;

a plurality of invertible bags, each bag including a collapsible surrounding wall having a closed bottom, an open top defining a top perimeter, a cavity for removably holding a ballast, and a pair of straps provided on said collapsible surrounding wall, each of said plurality of invertible bags including a semi-oval or semi-ellipse shape, wherein said top perimeter of each of said plurality of invertible bags includes a channel having at least one opening extending within said channel, said closure comprising a drawstring enclosed within said channel and extending partially outwards from said at least one opening, said drawstring openly closing said cavity, and wherein tension created by said main panel and said plurality of invertible bags holding a ballast, in conjunction with said elastic member is configured to eject a sand from said top side of said main panel; and further wherein a portion of each of said collapsible surrounding wall or said top perimeter of each plurality of invertible bags is attached to respective corners of said stretchable main panel providing an articulated connection where each of said plurality of invertible bags pivot freely about said corners when scooping said ballast.

* * * * *